US010920785B2

(12) United States Patent
Hattori et al.

(10) Patent No.: US 10,920,785 B2
(45) Date of Patent: Feb. 16, 2021

(54) PUMP

(71) Applicant: AISIN SEIKI KABUSHIKI KAISHA, Kariya (JP)

(72) Inventors: Shuji Hattori, Nagoya (JP); Kyohei Kitamura, Miyoshi (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 138 days.

(21) Appl. No.: 16/381,226

(22) Filed: Apr. 11, 2019

(65) Prior Publication Data

US 2019/0331125 A1 Oct. 31, 2019

(30) Foreign Application Priority Data

Apr. 27, 2018 (JP) ..... JP2018-086767

(51) Int. Cl.

| | |
|---|---|
| ***F04D 29/16*** | (2006.01) |
| ***F04D 29/22*** | (2006.01) |
| ***F04D 29/08*** | (2006.01) |
| ***F04D 29/049*** | (2006.01) |

(52) U.S. Cl.

CPC ..... *F04D 29/167* (2013.01); *F04D 29/049* (2013.01); *F04D 29/086* (2013.01); *F04D 29/2266* (2013.01); *F05D 2240/55* (2013.01)

(58) Field of Classification Search

CPC .. F04D 29/167; F04D 29/086; F04D 29/2266; F05D 2240/55

See application file for complete search history.

(56) References Cited

U.S. PATENT DOCUMENTS

| | | | | |
|---|---|---|---|---|
| 2,694,981 | A * | 11/1954 | Daugherty | F04D 29/628 415/201 |
| 5,613,845 | A * | 3/1997 | Moon | F04D 29/2266 417/423.11 |
| 2006/0147328 | A1 | 7/2006 | Ito et al. | |
| 2010/0284796 | A1 | 11/2010 | Mitsuda et al. | |
| 2011/0064566 | A1 * | 3/2011 | Wuerdig | F04D 29/167 415/174.2 |

FOREIGN PATENT DOCUMENTS

| | | | |
|---|---|---|---|
| CN | 206129682 | U | 4/2017 |
| JP | 2005207402 | A | 8/2005 |
| JP | 2009221938 | A | 10/2009 |
| KR | 101738910 | B1 | 5/2017 |

* cited by examiner

*Primary Examiner* — Eldon T Brockman
*Assistant Examiner* — Michael K. Reitz
(74) *Attorney, Agent, or Firm* — Buchanan Ingersoll & Rooney PC

(57) ABSTRACT

A pump includes a closed pump rotor being rotatably housed about a rotational axis in a pump space in a casing and including a shroud, a seal ring being shiftably provided, along the rotational axis, being coaxial with the rotational axis with respect to a cylindrical portion in a center of the shroud, and a shift mechanism configured to exert a shift force in a direction along the rotational axis with respect to the seal ring with rotation of the pump rotor and bring the seal ring into contact with an inner wall of the pump space.

12 Claims, 4 Drawing Sheets

PUMP

CROSS REFERENCE TO RELATED APPLICATIONS

This application is based on and claims priority under 35 U.S.C. § 119 to Japanese Patent Application 2018-086767, filed on Apr. 27, 2018, the entire content of which is incorporated herein by reference.

TECHNICAL FIELD

This disclosure generally relates to a pump which includes a closed pump rotor with a shroud and is structured to suppress a reverse flow of fluid at an outer peripheral portion of the shroud.

BACKGROUND DISCUSSION

As a pump having the configuration as described above, JP2009-221938A (Reference 1) discloses a technique of including sealing units between a casing and a shroud (a front shroud in Reference 1) of a pump rotor (an impeller in Reference 1) which rotates by a driving force of a canned motor.

Moreover, CN206129682Y (Reference 2) discloses, in view of the description and drawings, a technique of externally fitting a seal ring having a double structure in a radial direction with respect to a center portion of a shroud of a pump rotor, bringing an end surface of the seal ring into contact with a casing, and bringing an outer surface in a radial direction into contact with the casing.

Reference 2 aims to mitigate fluid leakage between the pump rotor (an impeller in Reference 2) and the casing in a centrifugal pump, and also discloses that an inner seal ring and an outer seal ring are relatively rotatable with each other, and one of the seal rings having a double structure is formed into an L-shaped cross-section, thereby improving sealing property.

Moreover, KR10-1738910 (Reference 3) discloses, in view of the description and drawings, a technique of externally fitting a seal ring at a center portion of a shroud of a pump rotor (an impeller in Reference 3) or internally fitting the seal ring at the center portion, and arranging an end portion of the seal ring to be contactable with an inner surface of a casing.

The Reference 3 aims to provide the impeller for minimizing inlet loss by minimizing a gap between an inlet part of the casing and an inflow part of the pump rotor, and discloses a configuration of integrally rotating the seal ring with the shroud, or a configuration of supporting the seal ring to the shroud so as to be extendable and retractable in a direction along an axis.

Each of the pumps disclosed in References 1 to 3 has a configuration of sucking fluid along a rotational axis of the pump rotor with rotation of the pump rotor, and discharging the fluid in a direction perpendicular to the rotational axis by utilizing a centrifugal force with the rotation.

In this type of pump, a central portion of the shroud has a low pressure and an outer peripheral portion of the pump rotor has a high pressure. Therefore, in a case where sealing property between an outer periphery of the shroud and the casing is low, fluid from the outer periphery of the pump rotor flows to the center side of the shroud, which deteriorates pump performance.

Regarding sealing property, the technique employing the sealing units as disclosed in Reference 1 requires a gap for avoiding exerting resistance to rotation of the pump rotor. In order to form the gap, high dimensional precision is required in the sealing units.

Moreover, as disclosed in Reference 2, the configuration of bringing the end surface of the seal ring into contact with the inner surface of the casing allows the contact portion to support the outer seal ring having a double structure to a housing, and the inner seal ring integrally rotates with the shroud. Therefore, it is also conceivable that a speed difference between the seal rings increases, thereby leading to damage and deteriorating pump performance due to friction generated between the seal rings.

Further, in the arrangement where the seal ring is fitted to the shroud as described in Reference 3, thrust action with rotation allows the end surface of the seal ring to come into contact with the inner surface of the casing and improve sealing property. However, it is also conceivable that, in a case where a rotational speed of the shroud is low, the end surface of the seal ring fails to come into contact with the inner surface of the casing, and the required sealing property fails to be obtained.

A need thus exists for a pump which is not susceptible to the drawback mentioned above.

SUMMARY

A pump according to this disclosure includes a closed pump rotor, a seal ring, and a shift mechanism. The closed pump rotor is rotatably housed about a rotational axis in a pump space in a casing and includes a shroud. The seal ring is shiftably provided, along the rotational axis, being coaxial with the rotational axis with respect to a cylindrical portion in a center of the shroud. The shift mechanism is configured to exert a shift force in a direction along the rotational axis with respect to the seal ring with rotation of the pump rotor and bring the seal ring into contact with an inner wall of the pump space.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be explained with reference to the attached drawings.

Entire Configuration

Figure 1:
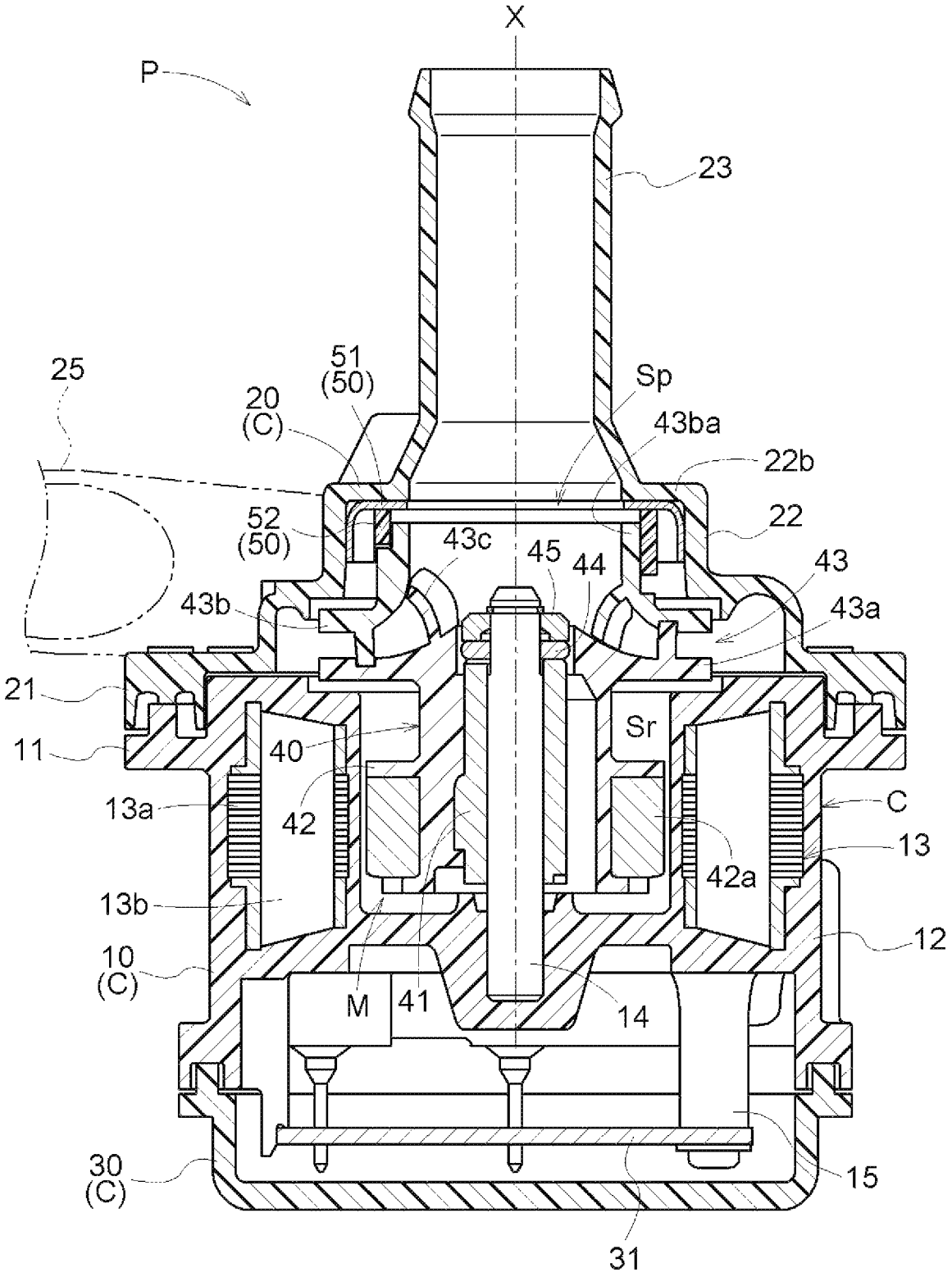
FIG. 1 is a cross-sectional view of a water pump in a state where a rotor rotates.

FIG. 1 illustrates a water pump P as a specific example where a pump houses, in a casing C, a pump rotor 43 which rotates around a rotational axis X by a driving force of a motor unit M, and includes, in the casing C, a suction cylinder 23 configured to suck cooling water (an example of fluid) and a discharge cylinder 25 configured to discharge the sucked cooling water.

The water pump P is configured as a centrifugal pump configured to suck cooling water from the suction cylinder 23 into a pump space Sp with rotation of the pump rotor 43 and to discharge the sucked cooling water in a tangential direction of the pump rotor 43 from the discharge cylinder 25.

The water pump P is used so as to circulate cooling water between an engine and a radiator in a vehicle such as an automobile. Note that the pump thus configured is not limited to the water pump P, but may be configured as a pump for discharging other fluid.

Specific Configuration of Pump

The water pump P can be used in any posture. However, in this embodiment, the upper and lower relations will be described based on a posture illustrated in FIG. 1.

As illustrated in FIG. 1, the casing C is configured by connecting a first casing 10 made of resin, a second casing 20 made of resin, and a third casing 30 made of resin. The casing C houses a rotor 40 in a space extending from a rotor space Sr formed in the first casing 10 to the pump space Sp formed in the second casing 20.

The rotor space Sr which is upwardly opened is formed in the first casing 10. A bulging portion 22 bulging upward in a cylindrical shape around the rotational axis X is formed in the second casing 20, and the pump space Sp is formed in a region extending downward from the inside of the bulging portion 22.

A first flange portion 11 and a second flange portion 21 are formed respectively at portions of the first casing 10 and the second casing 20, the portions being opposed to each other, and the flange portions are connected by a technique such as thermal welding or bonding, in order that the first casing 10 and the second casing 20 are connected in a watertight manner.

As illustrated in FIG. 1, the first casing 10 includes the rotor space Sr with a bottom being coaxial with the rotational axis X, and a stator 13 is buried in a side wall portion 12 surrounding the rotor space Sr. Moreover, the rotor space Sr includes a fixed shaft 14 being coaxial with the rotational axis X in a manner that a base end portion is inserted into a bottom wall portion of the first casing 10.

The stator 13 includes a core 13*a* obtained by stacking magnetic steel sheets, and a coil 13*b* formed of a conductive wire wound around the core 13*a*. The stator 13 is buried in a side wall of the first casing 10 by resin potting. The fixed shaft 14 has a circular cross-sectional shape, and an axial length is set in such a way that a tip end reaches the pump space Sp of the second casing 20.

Figure 2:
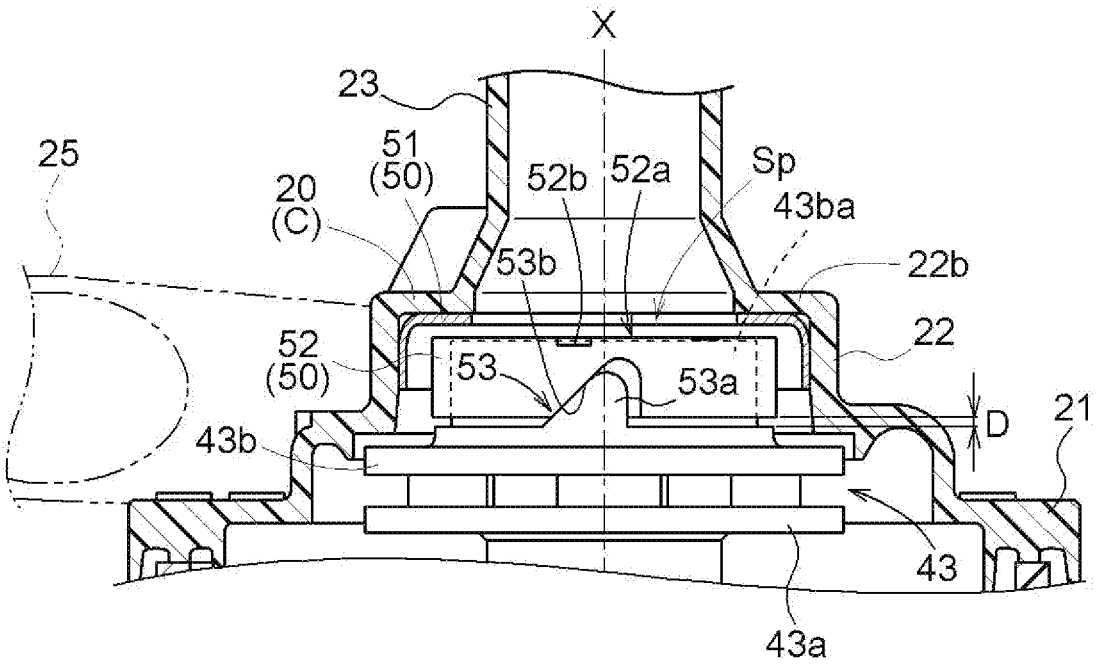
FIG. 2 is a cross-sectional view in a state where a seal ring is spaced away from a cover plate.

As illustrated in FIG. 1, in the second casing 20, the bulging portion 22 having a cylindrical shape being coaxial with the rotational axis X is formed to protrude upward, and the suction cylinder 23 is formed to protrude upward being coaxial with the rotational axis X from an upper wall 22*b* of the bulging portion 22 as illustrated in FIG. 2. Moreover, in the second casing 20, the discharge cylinder 25 is formed in a posture for discharging fluid in a tangential direction from an annular space surrounding the pump space Sp formed in the bulging portion 22.

As illustrated in FIG. 1, the third casing 30 is molded in a bowl shape that a center portion bulges downward for forming a space for housing a control board 31. The third casing 30 is connected to the bottom of the first casing 10 by a technique such as thermal welding or bonding.

A supporting portion 15 protruding downward is formed on a lower portion of the first casing 10, and the control board 31 is supported by the supporting portion 15.

As illustrated in FIG. 1, the rotor 40 includes a bearing 41 externally rotatably fitted to the fixed shaft 14, and is integrally configured with a motor rotor 42 located below and the closed pump rotor 43 located above.

A washer 44 and a bush 45, externally fitted to an upper end of the fixed shaft 14, are supported by the fixed shaft 14 in a locked state by a retaining ring. This structure prevents upward movement of the rotor 40.

The bearing 41 is assumed to be a sliding bearing with the fixed shaft 14, but may be configured by, for example, a needle bearing. Moreover, the motor rotor 42 includes a plurality of permanent magnets 42*a* at an outer periphery of the motor rotor 42.

The pump rotor 43 includes a base rotor 43*a* having a shape of protruding upward toward the center, a shroud 43*b* fixed at a predetermined interval on an upper surface side of the base rotor 43*a*, and an impeller 43*c* located between the base rotor 43*a* and the shroud 43*b*. Further, the shroud 43*b* is integrally formed with a cylindrical portion 43*ba* around the rotational axis X at the upper end.

Note that the impeller 43*c* is configured by a blade body integrally formed on a lower surface side of the shroud 43*b*, but may be integrally formed so as to protrude to an upper surface of the base rotor 43*a*.

Seal Portion

The water pump P generates a flow of cooling water toward an outer peripheral side from the central portion of the pump rotor 43 with drive-rotation of the pump rotor 43. This lowers pressure of the central portion of the pump rotor 43 and sucks cooling water from the suction cylinder 23, and then increases pressure of a portion close to an outer periphery of the pump rotor 43 in the pump space Sp and discharges the cooling water in the pump space Sp from the discharge cylinder 25.

Since a pressure difference is thus generated in the pump space Sp, pressure is exerted in a direction that the cooling water is made to reversely flow between the shroud 43*b* and the second casing 20 from a portion continuous to the outer periphery of the pump rotor 43 in the pump space Sp toward an opening portion of the tip end of the cylindrical portion 43*ba* of the shroud 43*b*.

In a case where the cooling water reversely flows due to exertion of the pressure, efficiency of the water pump P is lowered. For this reason, in order to suppress a reverse flow, a seal unit 50 is provided between the cylindrical portion 43*ba* of the shroud 43*b* and an inner wall of the bulging portion 22 (an inner wall of the pump space Sp) which opposes the cylindrical portion 43*ba*.

As illustrated in FIGS. 1 to 5, the seal unit 50 includes a cover plate 51 press-fitted and fixed into the bulging portion 22, a seal ring 52 externally fitted to the cylindrical portion 43*ba* of the shroud 43*b*, and a shift mechanism 53.

In the seal unit 50, the cover plate 51 is molded in a generally annular shape in which a side wall portion can closely adhere to an inner peripheral surface of the bulging portion 22, by pressing a stainless material. Then, an upper wall portion of the cover plate 51 is press-fitted and fixed so as to closely adhere to a lower surface of an upper wall 22*b* of the bulging portion 22, and thus a lower surface of the cover plate 51 serves as the inner wall of the pump space Sp, and a contact surface 52*a* of an upper end of the seal ring 52 is contactable.

The seal ring 52 is molded in a ring shape with high heat resistance and excellent durability materials such as a PPS (polyphenylene sulfide) resin. The seal ring 52 is externally fitted via a slight gap in a radial direction to the cylindrical portion 43*ba* of the shroud 43*b*, which allows the seal ring 52 to be movable in a direction along the rotational axis X.

The upper end of the seal ring 52 is formed with the contact surface 52*a* capable of coming into contact with the lower surface of the cover plate 51, and a portion of the contact surface 52*a* is formed with a plurality of foreign object discharging grooves 52*b* in a posture along a radial direction of the seal ring 52.

The shift mechanism 53 includes a contact body 53*a* formed on an outer periphery of the cylindrical portion 43*ba*, and an inclination guiding portion 53*b* formed by cutting away a part of the seal ring 52. Moreover, the inclination guiding portion 53*b* is configured as an inclined surface in a posture inclined with respect to the rotational axis X when viewed in a direction perpendicular to the rotational axis X so as to acquire a component force in the direction along the rotational axis X from a rotational force in a case where the shroud 43*b* is driven to rotate together with the pump rotor 43.

As illustrated in FIG. 2, in a state where the pump rotor 43 does not rotate, a gap D is formed between a back surface on the opposite side of the contact surface 52*a* of the seal ring 52 and an upper surface of the shroud 43*b* associated with the back surface.

Figure 3:
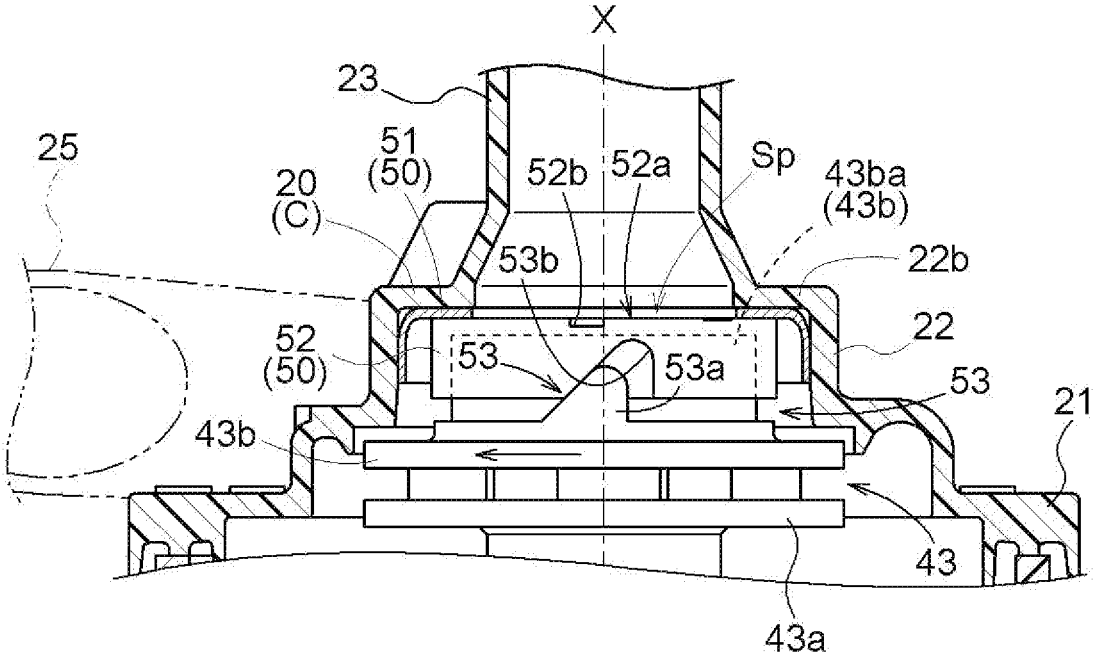
FIG. 3 is a cross-sectional view in a state where the seal ring comes into contact with the cover plate.
Figure 4:
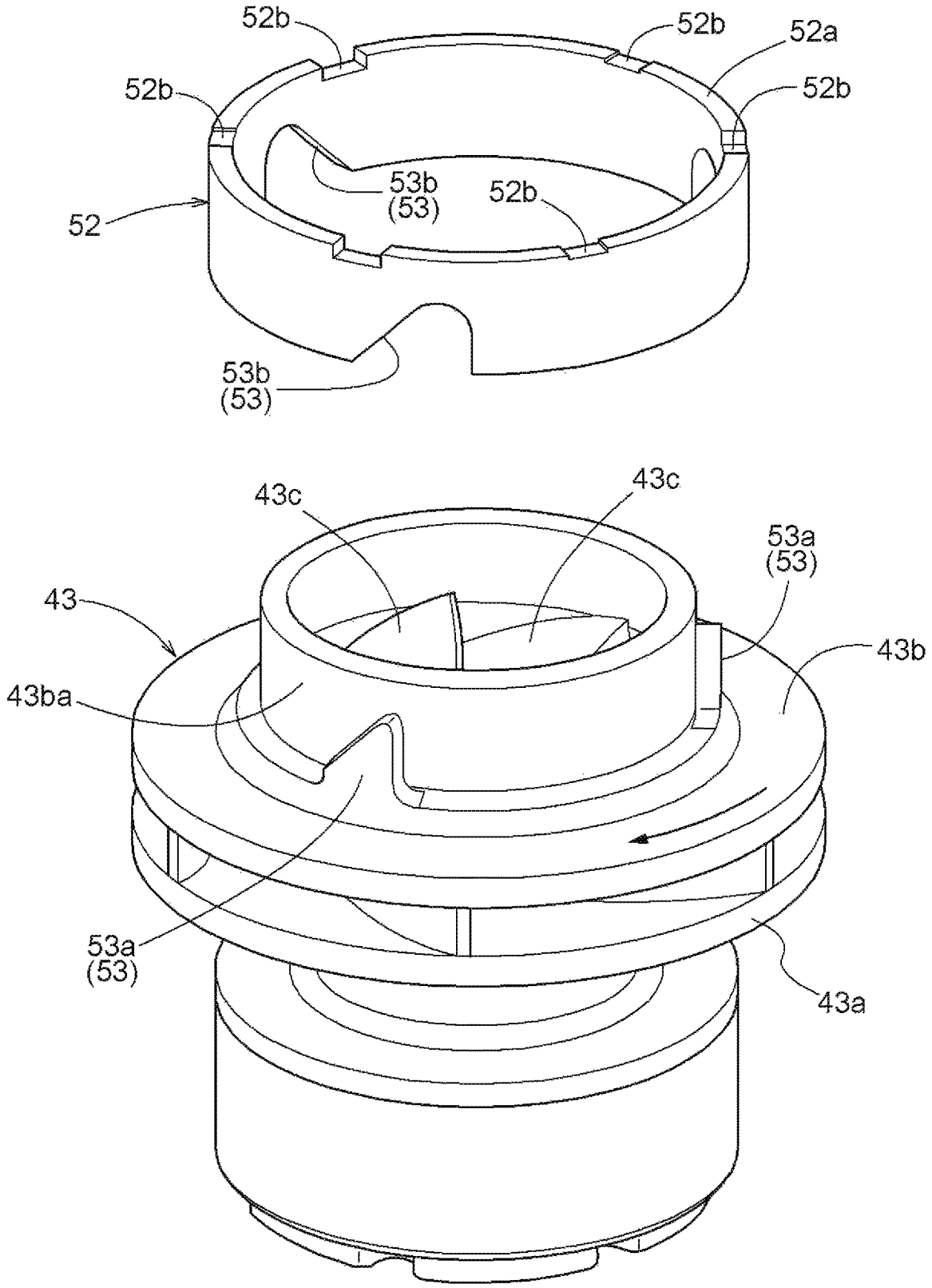
FIG. 4 is an exploded perspective view of a shroud and the seal ring.
Figure 5:
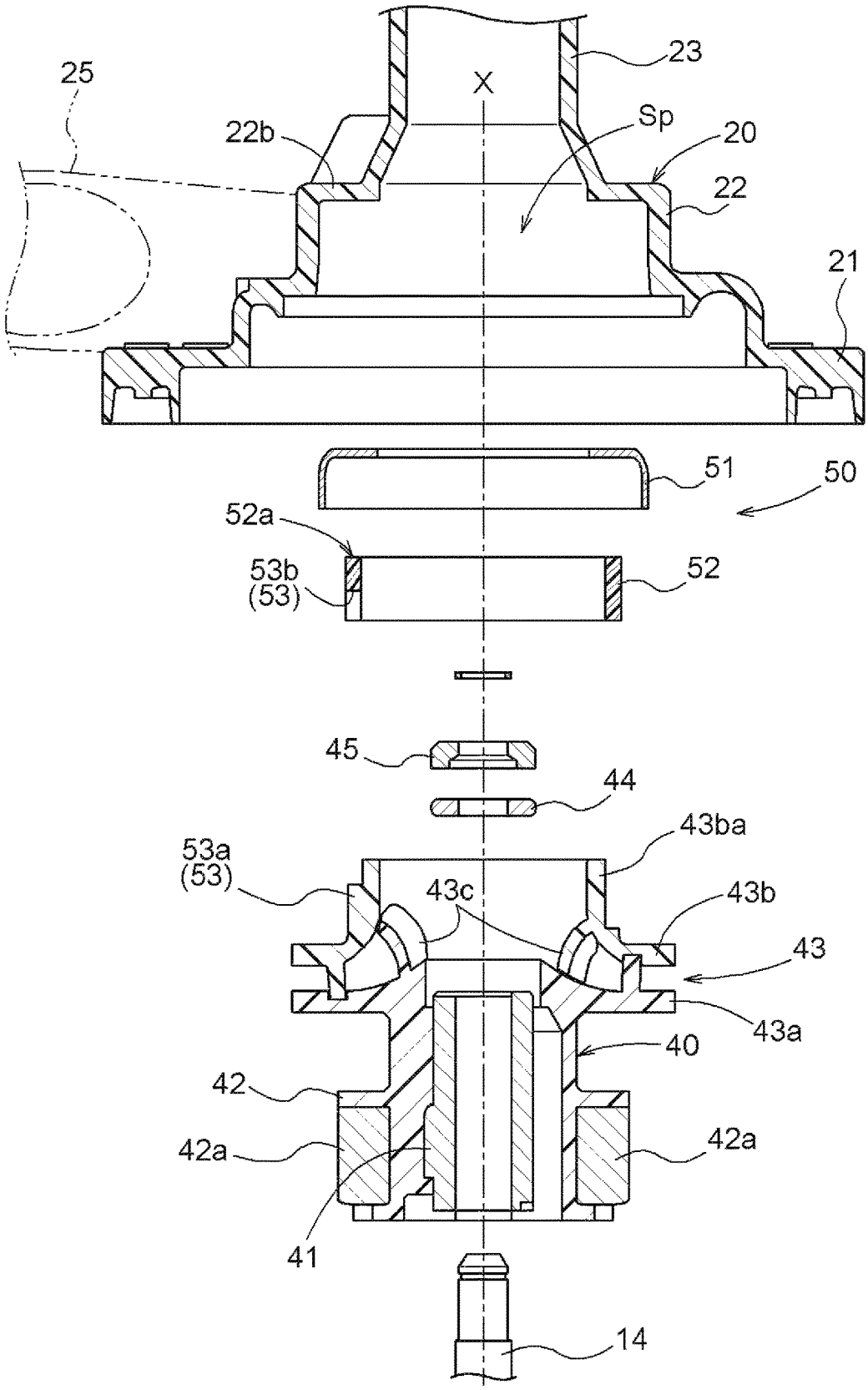
FIG. 5 is a cross-sectional view in a state where a second casing, the cover plate, the seal ring, and the like are separated.

Since the seal unit 50 is thus configured, in a case where the pump rotor 43 rotates in a direction depicted by arrows in FIGS. 3 and 4, the seal ring 52 rotates with a delay due to resistance exerted from cooling water. Therefore, in a case where the shroud 43*b* rotates together with the pump rotor 43, a speed difference between the cylindrical portion 43*ba* and the seal ring 52 allows the shift mechanism 53 to exert a shift force directed toward the direction along the rotational axis X to the seal ring 52 and shift the seal ring 52 upward. The shift operation allows the contact surface 52*a* of the upper end of the seal ring 52 to bring into contact with the lower surface of the cover plate 51, and the contact portion blocks cooling water reversely flowing between the seal ring 52 and the second casing 20 from a portion continuous to the outer periphery of the pump rotor 43 toward an opening portion of the tip end of the cylindrical portion 43*ba* of the shroud 43*b*.

Moreover, in a case where the seal ring 52 is shifted, cooling water is supplied via the gap D between a back surface of the seal ring 52 and the shroud 43*b*. Accordingly, water pressure is exerted to the back surface of the seal ring 52 with rotation of the shroud 43*b*, which, in comparison with a case where the gap D is not formed, achieves a rapid shift operation of the seal ring 52 without incurring a disadvantage of closely adhering a lower end of the seal ring 52 to the upper surface of the shroud 43*b*.

Moreover, in a case where particulate foreign objects are contained in cooling water, the particulate foreign objects flow into an internal space of the cylindrical portion 43*ba* of the shroud 43*b* together with the cooling water via the foreign object discharging grooves 52*b* formed on the contact surface 52*a* of the seal ring 52, and thus the particulate foreign objects do not remain on the contact surface 52*a*.

With this configuration, in a case where cooling water sucked from the suction cylinder 23 is discharged to an outside via the discharge cylinder 25, the contact surface 52*a* of an upper end of the seal ring 52 brings into contact with the lower surface of the cover plate 51 even when the pump rotor 43 rotates at a low speed, which prevents a phenomenon that the cooling water reversely flows toward the opening portion of the tip end of the cylindrical portion 43*ba* of the shroud 43*b* from between the seal ring 52 and the second casing 20 and discharges the cooling water with high efficiency.

Other Embodiments

This disclosure may be configured as follows other than the embodiment described above (components having the same functions as those of the embodiment are given the same reference numerals and symbols as those described in the embodiment).

(a) The seal ring 52 may be internally fitted to the cylindrical portion 43*ba* of the shroud 43*b* and be configured, as the shift mechanism 53, by the contact body 53*a* formed in an inner periphery of the cylindrical portion 43*ba* and the inclination guiding portion 53*b* formed in an outer periphery of the seal ring 52. Note that the inclination guiding portion 53*b* may be formed by cutting away a part of the seal ring 52.

(b) As the shift mechanism 53, the contact body 53*a* may be formed to the seal ring 52 and the inclination guiding portion 53*b* may be formed to the cylindrical portion 43*ba*. Even arrangement where the contact body 53*a* and the inclination guiding portion 53*b* are thus formed allows the seal ring 52 to be shifted.

(c) The contact body 53*a* may be configured by a ring body which fixes a pin on an outer surface of the cylindrical portion 43*ba* of the shroud 43*b* and is rotatably supported with respect to the pin. With this configuration, the ring body as the contact body 53*a* rotates in contact with the inclination guiding portion 53*b* at a time of a shift operation, which makes it possible to perform the shift operation lightly.

(d) The inclination guiding portion 53*b* may be configured by a slit in an inclined posture which is inclined with respect to the rotational axis X when viewed in a direction perpendicular to the rotational axis X in an outer peripheral portion of the seal ring 52. Similarly, the inclination guiding portion 53*b* may also be configured by grooves formed in an inner periphery of the seal ring 52 in an inclined posture.

In arrangement where the inclination guiding portion 53*b* is configured by the slit in the configuration of the other embodiment (d), the shift mechanism 53 is configured by providing the contact body 53*a* having a pin-shape being inserted through the slit on the outer periphery of the cylindrical portion 43*ba*. Moreover, in arrangement where the inclination guiding portion 53*b* is configured by the grooves in the configuration of the other embodiment (d), the shift mechanism 53 is configured by providing the pin-shaped contact body 53*a* engaged with the grooves on the outer periphery of the cylindrical portion 43*ba*.

The other embodiment (d) has been described by way of an example where the seal ring 52 is externally fitted to the cylindrical portion 43*ba*, but may be similarly applied to a configuration in which the seal ring 52 is internally fitted to the cylindrical portion 43*ba*.

This disclosure is applicable to a pump which includes a closed pump rotor with a shroud, and a seal ring for suppressing a reverse flow of fluid at a portion of the shroud.

A pump according to this disclosure includes a closed pump rotor, a seal ring, and a shift mechanism. The closed pump rotor is rotatably housed about a rotational axis in a pump space in a casing and includes a shroud. The seal ring is shiftably provided, along the rotational axis, being coaxial with the rotational axis with respect to a cylindrical portion in a center of the shroud. The shift mechanism is configured to exert a shift force in a direction along the rotational axis with respect to the seal ring with rotation of the pump rotor and bring the seal ring into contact with an inner wall of the pump space.

According to such a feature configuration, in a case where the pump rotor rotates, it is possible to bring an end surface of the seal ring provided in the shroud into contact with the inner wall of the pump space by the shifting force of the shift mechanism. This configuration in which the seal ring is shifted eliminates necessity to set dimensional precision of the seal ring to be high in a direction that the seal ring is shifted. Further, there is no damage caused by bringing the seal ring into contact with the inner wall of the pump space with an excessive pressing force. Moreover, even in a case where the pump rotor rotates at a low speed, it is also possible to bring the end surface of the seal ring into contact with the pump space.

Therefore, the pump is configured to effectively suppress fluid leakage at a center portion of the shroud by the seal ring.

In the pump according to this disclosure, the shift mechanism may include a contact body, and an inclination guiding portion configured to acquire a component force to a shift direction from a rotational force of the shroud by being in contact with the contact body, and the contact body may be formed to one of the shroud and the seal ring, and the inclination guiding portion may be formed to the other of the shroud and the seal ring. In a case where the seal ring is externally fitted to the cylindrical portion of the shroud, the contact body may be formed on an outer periphery of the cylindrical portion, and the inclination guiding portion may be formed by cutting away a part of the seal ring. In a case where the seal ring is internally fitted to the cylindrical portion of the shroud, the contact body may be formed on an inner periphery of the cylindrical portion, and the inclination guiding portion may be formed by cutting away a part of the seal ring.

With this configuration, the contact body brings into contact with the inclination guiding portion at a time of rotating the shroud, which makes it possible to acquire a component force to a shift direction from a rotational force of the shroud. Moreover, the contact body may be formed to one of the shroud and the seal ring, and the inclination guiding portion may be formed to the other of the shroud and the seal ring, which makes it possible to freely make a choice of placing the contact body and the inclination guiding portion at a time of designing and acquire a reasonable configuration.

In the pump according to this disclosure, a foreign object discharging groove in a posture along a radial direction of the seal ring may be formed in a contact surface which is in contact with the inner wall of the pump space in the seal ring.

With this configuration, even in a situation where a foreign object is caught between the contact surface of the seal ring and the inner wall of the pump space, the foreign object can be flowed and discharged together with fluid via a foreign object discharging groove. For example, it is also possible to prevent a disadvantage that the foreign object lingers for a long time and deteriorates sealing property.

In the pump according to this disclosure, in a situation where a shift force from the shift mechanism fails to be exerted, a gap may be formed between the shroud and a back surface on an opposite side of a contact surface which is in contact with the inner wall of the pump space in the seal ring.

With this configuration, for example, in comparison with a case where the back surface of the seal ring closely adheres to the shroud, a shift force exerted from the shift mechanism to the seal ring allows fluid to flow into the back surface of the seal ring, which achieves a rapid shift of the seal ring.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A pump, comprising:

a closed pump rotor being rotatably housed about a rotational axis in a pump space in a casing and including a shroud;

a seal ring being shiftably provided, along the rotational axis, being coaxial with the rotational axis with respect to a cylindrical portion in a center of the shroud; and a shift mechanism configured to exert a shift force in a direction along the rotational axis with respect to the seal ring with rotation of the pump rotor and bring the seal ring into contact with an inner wall of the pump space.

2. The pump according to claim 1, wherein the shift mechanism includes a contact body, and an inclination guiding portion configured to acquire a component force to a shift direction from a rotational force of the shroud by being in contact with the contact body, and the contact body is formed to one of the shroud and the seal ring, and the inclination guiding portion is formed to the other of the shroud and the seal ring.

3. The pump according to claim 1, wherein the seal ring is externally fitted to the cylindrical portion of the shroud, the shift mechanism includes a contact body, and an inclination guiding portion configured to acquire a component force to a shift direction from a rotational force of the shroud by being in contact with the contact body, and the contact body is formed on an outer periphery of the cylindrical portion, and the inclination guiding portion is formed by cutting away a part of the seal ring.

4. The pump according to claim 1, wherein the seal ring is internally fitted to the cylindrical portion of the shroud, the shift mechanism includes a contact body, and an inclination guiding portion configured to acquire a component force to a shift direction from a rotational force of the shroud by being in contact with the contact body, and the contact body is formed on an inner periphery of the cylindrical portion, and the inclination guiding portion is formed by cutting away a part of the seal ring.

5. The pump according to claim 1, wherein a foreign object discharging groove in a posture along a radial direction of the seal ring is formed in a contact surface which is in contact with the inner wall of the pump space in the seal ring.

6. The pump according to claim 2, wherein a foreign object discharging groove in a posture along a radial direction of the seal ring is formed in a contact surface which is in contact with the inner wall of the pump space in the seal ring.

7. The pump according to claim 3, wherein a foreign object discharging groove in a posture along a radial direction of the seal ring is formed in a contact surface which is in contact with the inner wall of the pump space in the seal ring.

8. The pump according to claim 4, wherein a foreign object discharging groove in a posture along a radial direction of the seal ring is formed in a contact surface which is in contact with the inner wall of the pump space in the seal ring.

9. The pump according to claim 1, wherein, in a situation where a shift force from the shift mechanism fails to be exerted, a gap is formed between the shroud and a back surface on an opposite side of a contact surface which is in contact with the inner wall of the pump space in the seal ring.

10. The pump according to claim 2, wherein, in a situation where a shift force from the shift mechanism fails to be exerted, a gap is formed between the shroud and a back surface on an opposite side of a contact surface which is in contact with the inner wall of the pump space in the seal ring.

11. The pump according to claim 5, wherein, in a situation where a shift force from the shift mechanism fails to be exerted, a gap is formed between the shroud and a back surface on an opposite side of a contact surface which is in contact with the inner wall of the pump space in the seal ring.

12. The pump according to claim 6, wherein, in a situation where a shift force from the shift mechanism fails to be exerted, a gap is formed between the shroud and a back surface on an opposite side of a contact surface which is in contact with the inner wall of the pump space in the seal ring.

* * * * *